United States Patent [19]

Ramsey et al.

[11] 4,420,154

[45] Dec. 13, 1983

[54] WEIGHTLIFTING APPARATUS

[76] Inventors: John T. Ramsey; William J. Ramsey, both of 3807 S. Webb Rd., Wichita, Kans. 67210

[21] Appl. No.: 205,929

[22] Filed: Nov. 12, 1980

[51] Int. Cl.[3] ..... A63B 21/06

[52] U.S. Cl. ..... 272/118; 272/DIG. 4; 272/123

[58] Field of Search ..... 272/123, 122, 118, 134, 272/144, 62, 102; 124/87

[56] References Cited

U.S. PATENT DOCUMENTS

| | | | |
|---|---|---|---|
| 321,388 | 6/1885 | Ruebsam | 272/118 |
| 3,235,255 | 2/1966 | Leflar | 272/123 |
| 3,346,256 | 10/1967 | White | 272/118 |
| 4,153,244 | 5/1979 | Tauber | 272/117 |

FOREIGN PATENT DOCUMENTS

| | | | |
|---|---|---|---|
| 456790 | 3/1928 | Fed. Rep. of Germany | 272/123 |
| 2420736 | 11/1979 | France | 124/87 |

*Primary Examiner*—Richard C. Pinkham
*Assistant Examiner*—William R. Browne
*Attorney, Agent, or Firm*—John H. Widdowson

[57] ABSTRACT

A weightlifting apparatus and method for preventing injury to a weightlifter from a weightlifting bar including weights thereon in the event of physical collapse of the weightlifter. The apparatus includes a framework having a base, a brace, a first pair of vertical support members secured to the brace and to the base and having a first slot therebetween with a structure defining a plurality of first apertures; and a second pair of vertical support members secured to the brace and to the base and having a second slot therebetween with a structure defining a plurality of second apertures. An adjustment body with adjustment apertures is slidably and adjustably mounted within the first slot and another adjustment body within the second slot. A bolt is threadably secured to the adjustment body for finely adjusting the height of a resting weightlifting bar with respect to a weightlifter. The process comprises placing the adjustment body within the first slot and the second slot, and inserting a pin through the first apertures and the adjustment apertures to retain one of the adjustment bodies within the first slot, and inserting another pin through the second apertures and the adjustment apertures of another adjustment body to retain the other adjustment body in the second slot.

5 Claims, 4 Drawing Figures

WEIGHTLIFTING APPARATUS

BACKGROUND OF THE INVENTION

1. Field of the Invention

This invention is related to a weightlifting apparatus. More specifically, this invention provides for a weightlifting apparatus and a method for preventing injury to a weightlifter.

2. Description of the Prior Art

U.S. Pat. No. 3,235,255 by Leflar discloses a bar bell exercising apparatus having stops to arrest the fall of a bar bell. U.S. Pat. No. 3,346,256 by White comprises a lifting bar carrying the weight, guidably supported on a pair of vertical uprights. Stop means in the form of a clamping collar are provided to limit the movement in a downward direction of the weight bar so that if the same is dropped it will only go as far as the adjusted position of the collar. U.S. Pat. No. 4,153,244 by Tauber, Jr. discloses a weightlifting device and exercising apparatus wherein the weightlifting portion of the assembly includes a weight bar slidably supported on vertical uprights and adjusted insofar as vertical position is concerned by pins. None of the foregoing prior art teaches or suggests the particular weightlifting apparatus of this invention.

SUMMARY OF THE INVENTION

This invention accomplishes its desired objects by providing a weight-lifting apparatus for preventing injury to a weightlifter from a weightlifing bar having weights thereon in the event of physical collapse of the weightlifter comprising a framework including a base, a brace, a first pair of vertical support members generally being secured to one end of the brace and to the base, and a second pair of vertical support members securing to the other end of the brace and to the base. The vertical support members of the first pair are positioned in proximity to each other creating a first slot and each vertical support member of the first pair includes a structure defining a plurality of first slot apertures. The vertical support members of the second pair are positioned in proximity to each other creating a second slot and each vertical support member of the second pair has a structure defining a plurality of second slot apertures. The first slot apertures on the first pair of vertical support members and the second slot apertures on the second pair of vertical support members are in registry. An adjustment means is slidably and adjustably mounted within the first slot and within the second slot for supporting the weightlifting bar and adjusting the height of same with respect to the weightlifter. Fine adjustment means is mounted on each of the adjustment means for additionally supporting the weightlifting bar and closely adjusting the height of the bar relative to the weightlifter. The process comprises placing the adjustment means within the first slot and within the second slot, and inserting a pin through the first slot apertures and the adjustment apertures to retain one of the adjustment bodies within the first slot, and inserting another pin through the second slot apertures and the adjustment apertures of another adjustment body to retain the adjustment body in the second slot. The process also comprises attaching a fine adjustment means to the adjustment means.

It is an object of the invention to provide a novel weightlifting apparatus and process for preventing injury to a weightlifter.

Still further objects of the invention reside in the provision of a weightlifting apparatus that is capable of finely adjusting the height of the weightlifting bar relative to the weightlifter.

These together with the various ancillary objects and features will become apparent as the following description proceeds, are attained by this apparatus, preferred embodiments being shown in the accompanying drawings, by way of example only, wherein:

DETAILED DESCRIPTION OF THE INVENTION

Figure 1:
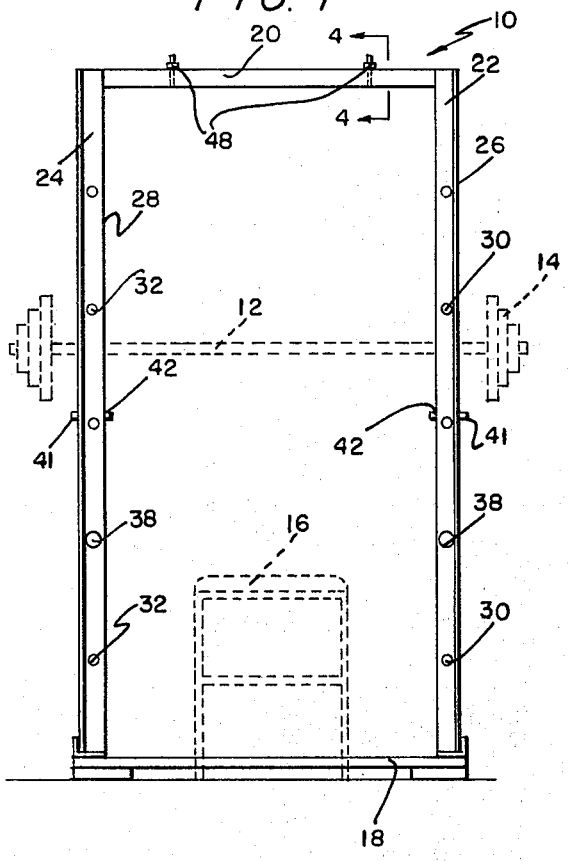
FIG. 1 is a front elevational view of the weightlifting apparatus.
Figure 2:
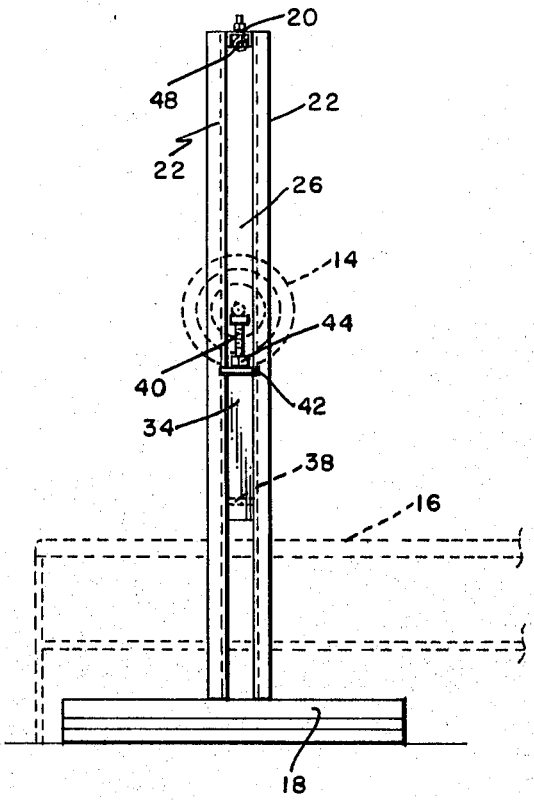
FIG. 2 is a side elevational view of the apparatus.
Figure 3:
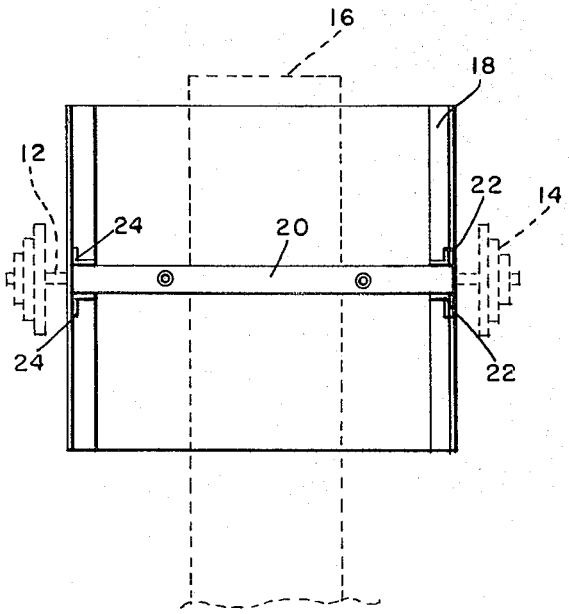
FIG. 3 is a top plan view of the apparatus.
Figure 4:
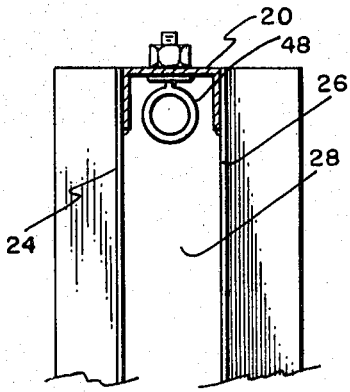
FIG. 4 is a partial vertical sectional view taken along the plane of line 4—14 in FIG. 1.
Figure 5:
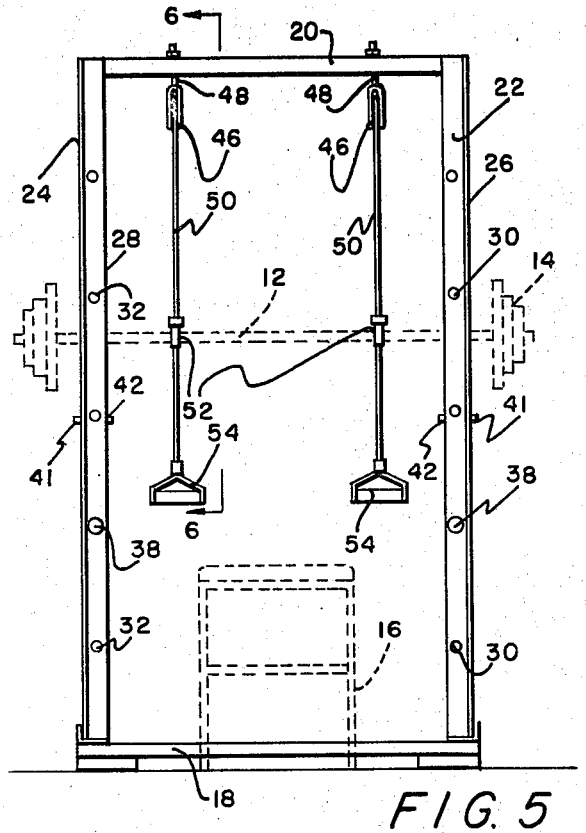
FIG. 5 is a front elevational view of the weightlifting apparatus including the pulleys.
Figure 6:
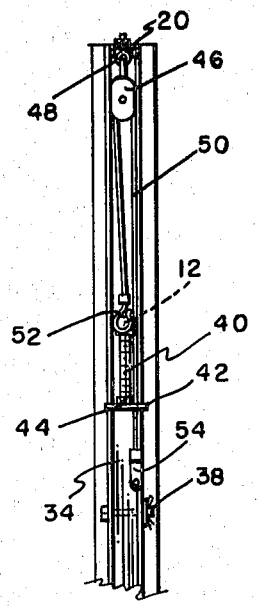
FIG. 6 is a partial vertical sectional view taken along the plane of line 6—6 in FIG. 5.
Figure 7:
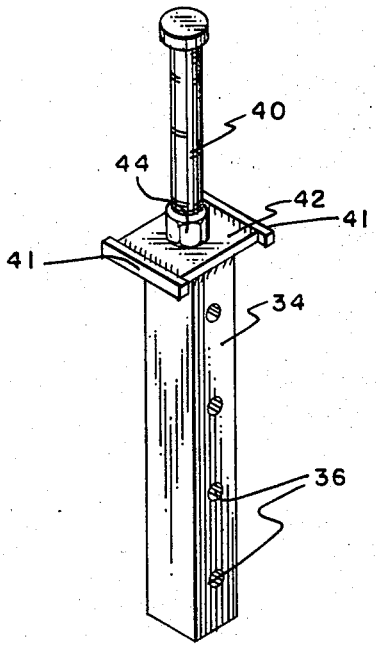
FIG. 7 is a perspective view of the height adjustment body having the bolt like member secured thereto.

Referring in detail now to the drawings, wherein like reference numerals designate similar parts throughout the various views, there is seen a weightlifting apparatus, generally illustrated as 10, for preventing injury to a weightlifter from a weightlifting (dotted line) bar 12, having (dotted line) weights 14—14 on each end, in the event of physical collapse of the weightlifter; and for closely adjusting the height of the bar 12 relative to a weightlifter on a (dotted line) bench 16. The weightlifting apparatus 10 has a base 18, and a brace 20. A first pair of vertical support members 22—22 is secured to one end of the brace 20 and to the base 18, and a second pair of vertical support members 24—24 is secured to the other end of the brace 20 and to the base 18. The support members 22—22 and support members 24—24 are respectively positioned in proximity to each other such as to create a first slot 26 and a second slot 28, respectively. Support members 22—22 and support members 24—24, respectively, have a structure defining a plurality of apertures 30—30 and 32—32, respectively. Apertures 30 (as well as apertures 32 in support members 24—24) in support members 22—22 are in registry. A generally hollow rectangular body (adjustment means) 34—34 is slidably and adjustably mounted within the slot 26 and within the slot 28, and includes a structure defining a plurality of adjustment apertures 36 collineating with apertures 30—30 and 32—32. Bodies 34—34 support the weightlifting bar 12 and is capable of adjusting the height of the bar 12 with respect to a weightlifter by the use of removable pins 38—38 slidably mounting through apertures 30—30 and adjustment apertures 36, and through apertures 32—32 and adjustment apertures 36. Bolt-like members 40—40 (close or fine adjustment means) having rectangular ridges 41—41 is threadably mounted on each of the bodies 34—34 for additionally supporting the weightlifting bar 12 and closely adjusting the height of the bar 12 relative to the weightlifter by either clockwise rotation (for lowering) of the bolt-like member 40—40 or counterclockwise rotation (for raising). Plate members 42—42 are positioned between each of the bolt-like members 40—40 and the bodies 34—34 for stabilizing each of the combined bolt-like members 40—40 and bodies 34—34 within slot 26 and slot 28. Nuts 44—44 can be rigidly attached to plates 42—42 in any suitable manner, such as by spot welding. Or, as one skilled in the art will appreciate plates 42—42 can be drilled and the holes threaded to receive bolts 40—40. In the latter instance lock nuts could be employed if desired to secure the positioning of bolts 40—40, and such lock nuts would be as shown in the drawings as nuts 44—44. In this instance, when the height of bolts 40—40 is to be finely adjusted with respect to the weightlifter, nuts 44—44 are counterclockwise loosened in order to either lower (by clockwise rotation) bolts 40—40 or to raise (by counterclockwise rotation) bolts 40—40. Subsequent to the fine adjustment of bolts 40—40, nuts 44—44 may then be tightened against plates 42—42 to secure bolts 40—40 in place. A pair of pulleys 46—46 is secured to rings 48—48 (which are attached to brace 20) for receiving lines 50—50 having hooks 52—52 on one end thereof for engaging the bar 12 and handles 54—54 for grasping by the weightlifter.

With continuing reference to the drawings for operation of the invention, and the process for, in combination, preventing injury to the weightlifter from the weightlifting bar 12 having weights 14—14 as the bar 12 rides in slots 26, 28 and for finely adjusting the height of the bar 12 relative to the weightlifter, the weightlifter positions himself on his back on bench 16 and approximates, depending upon the length of his or her arms, where adjustment bodies 34—34 should be within slots 26, 28. Subsequently, pin 38 is inserted (with respect to slot 26) through an aperture 30 of one vertical support member 22, through an adjustment aperture 36 of one adjustment body 34, and through an aperture 30 of the other vertical support member 22, in order stated, for retaining an adjustment body 34 within slot 26. Then another pin 38 is inserted (with respect to slot 28) through an aperture 32 of one vertical support member 24, through an adjustment aperture 36 of another adjustment body 34, and through an aperture 32 of the other vertical support member 24, in order stated, for retaining the other adjustment body 34 within slot 28. The height of bar 12 can be further finely adjusted (subsequently) with respect to the arms of the weightlifter by bolts 40—40 threadably securing within bodies 34—34 by counterclockwise loosening nuts 44—44 from plates 42—42 (which stabilize bodies 34—34 and bolts 40—40 within slots 26, 28 when bar 12 rests on bolts 40—40) in order to either lower (by clockwise rotation) bolts 40—40 (and lower bar 12 when resting thereon with respect to the weightlifter) or to raise (by counterclockwise rotation) bolts 40—40 (and thereby raise bar 12, when resting thereon, with respect to the weightlifter). Nuts 44—44 may then be tightened against plates 42—42 to secure bolts 40—40 within the bodies 34—34 and keep bolts 40—40 from rotating to lose the fine height adjustment with respect to the weightlifter. Similar height adjustments can be made when the weightlifter utilizes the pulleys 46—46 and lines 50—50 in combination, especially since the length of lines 50—50 is constant and the only variable would be the length of various weightlifter's arms and the type of exercise to be performed with respect to how the weightlifter grasps handles 54—54 as hooks 52—52 engage the bar 12. As the weightlifting bar 12 rides within slots 26, 28, this invention allows the weightlifter to load as many weights 14—14 as desired to bar 12 without being concerned with injury should a physical collapse occur during an exercise because bolts 40—40 (secured to bodies 34—34) will arrest the fall of bar 12 before coming down on top of the weightlifter. This invention also allows a weightlifter to finely adjust the height of bar 12 relative to the weightlifter's body.

While the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the scope of the invention as set forth.

We claim:

1. A weightlifting apparatus for preventing injury to a weightlifter from a weightlifting bar including weights thereon in the event of physical collapse of the weightlifter comprising a framework having a base, a brace, a first pair of vertical support members generally being secured to one end of said brace and to said base, and a second pair of vertical support members generally securing to the other end of said brace and to said base, said vertical support members of said first pair being positioned in proximity to each other creating a first slot and each vertical support members of said first pair including a structure defining a plurality of first slot apertures, said vertical support members of said second pair being positioned in proximity to each other creating a second slot and each vertical support members of said second pair including a structure defining a plurality of second slot apertures, said first slot apertures in said first pair vertical support members and said second slot apertures in said second pair vertical support members being in registry, adjustment means is slidably and adjustably mounted within said first slot and within said second slot for supporting said weightlifting bar and adjusting the height of same with respect to the weightlifter, and fine adjustment means mounted on each of said adjustment means for additionally supporting said weightlifting bar and closely adjusting the height of said bar relative to the weightlifter, said weightlifting apparatus preventing injury to the weightlifter as said weightlifting bar rides within said first and second slots in that if the weightlifting bar and weights are dropped by the weightlifter the fine adjustment means and adjustment means will arrest the falling before injurying the weightlifter, each of said adjustment means comprises a generally rectangular body having a structure defining a plurality of adjustment apertures, at least two pin means for retaining said adjustment means in said first slot and in said second slot, by inserting one of said pin means through said first slot apertures of one first pair vertical support members, said adjustment apertures of one adjustment means, and through said first slot apertures of the other first pair vertical support members, in order stated, for retaining one of the adjustment means in said first slot, and by inserting the other of said pin means through said second slot apertures of one second pair vertical support members, through said adjustment apertures of another adjustment means, and through said second slot apertures of the other second pair vertical support members, in order stated, for retaining the other adjustment means within the second slot, said fine adjustment means comprising a bolt-like member threadably engaging each of said adjustment means; and a plate-like member positioned between each of said fine adjustment means and said adjustment means for stabilizing each of the combined fine adjustment means and adjustment means within the first slot and within the second slot.

2. The weightlifting apparatus of claim 1 additionally including at least one pulley means on said brace for, in operation, receiving a line having a hook means on one end for engaging the weightlifting bar, and a handle means on the other end of said line for grasping by the weightlifter.

3. The weightlifting apparatus of claim 1 comprising a pair of pulleys attached to said brace.

4. A process comprising the steps of:

(a) placing a bar height adjustment device within a first slot between a first pair of vertical support members and within a second slot between a second pair of vertical support members so as to register apertures in the adjustment devices with the apertures in the vertical support members;

(b) inserting a first pin through apertures in the support members and the adjustment devices so as to hold the devices in the slots;

(c) attaching a bar height fine adjustment device to each adjustment device for closely adjusting the final height of a weightlifting bar relative to a user and for supporting a weightlifting bar and arresting the fall of a bar in the event a weightlifting bar is dropped by the user;

(d) stabilizing each fine adjustment device and adjustment device within the slots by positioning a plate between each of the fine adjustment devices and the adjustment devices; and (e) threadably adjusting the fine adjustment device so as to vary the height of a weightlifting bar relative to a user.

5. The process of claim 4 additionally comprising attaching at least one pulley to a brace for, in operation, receiving a line having a hook on one end for engaging a weightlifting bar, and a handle on the other end of a line for grasping by a user.

* * * * *